United States Patent [19]

Carmichael, III

[11] 4,028,899

[45] June 14, 1977

[54] ANCHORING SYSTEM FOR A FLOATING DOCK

[76] Inventor: Daniel A. Carmichael, III, P.O. Box 112, Cedarville, Mich. 49719

[22] Filed: Jan. 14, 1976

[21] Appl. No.: 648,976

[52] U.S. Cl. ..... 61/48; 61/64; 61/65; 248/55

[51] Int. Cl.[2] ..... E02B 3/20

[58] Field of Search ..... 61/64, 65, 48, 52, 49; 248/55, 74 A

[56] References Cited

UNITED STATES PATENTS

| | | | |
|---|---|---|---|
| 813,588 | 2/1906 | Rollins | 248/55 |
| 1,900,319 | 3/1933 | Vermeulen | 61/48 |
| 2,857,872 | 10/1958 | Usab | 114/.5 |
| 2,984,076 | 5/1961 | Bradley | 61/48 |
| 3,306,053 | 2/1967 | Fulton | 61/48 |
| 3,614,871 | 10/1971 | Nordell | 61/65 X |
| 3,626,447 | 12/1971 | Hindlin | 61/65 X |

*Primary Examiner*—Dennis L. Taylor
*Attorney, Agent, or Firm*—William S. Rambo

[57] ABSTRACT

A floating dock is moored between bottom-anchored, upright piles by bearing and binding plates which permit the dock to move up and down with relatively gradual changes in water level, but which prevent the dock from rolling or pitching under wave action.

1 Claim, 4 Drawing Figures

ANCHORING SYSTEM FOR A FLOATING DOCK

BACKGROUND OF THE INVENTION

This invention relates generally to floating docks, wharfs, boat houses and the like, and more specifically to an improved system or apparatus for mooring a floating dock in a manner to permit it to follow the level of the body of water in which it floats, while preventing it from pitching or rolling under comparatively short cycle wave action.

The anchoring or mooring of floating docks is an age old problem. Prior art mooring systems for floating docks range from flexible cables or wires secured between the dock and a bottom embedded stone or other anchor, to sliding rings or loops fastened to the sides of the dock and slidably encircling one or more bottom embedded pipes or piles.

However, while these prior art mooring systems serve to secure the dock in a desired position and permit it to rise and fall with change in water level, they completely fail to hold the dock against undesired pitching, rolling or tossing movement when it is subjected to waves, boat wakes and the like.

SUMMARY AND OBJECTS OF THE INVENTION

This invention provides an improved means for mooring a floating dock to a plurality of generally vertical, bottom-anchored piles, so that the dock will move up and down with a gradual change of water level, such as may be due to seasonal flooding or tidal changes, but which will prevent the dock from rocking or tilting under relatively short cycle wave action. The present dock-mooring system takes the form of a plurality of bearing and clamping plates which are secured to the sides of the dock in snug, but sliding engagement with a like number of piles. A zero clearance is preferably maintained between the clamping plates and the piles so that any tendency on the part of the dock to tilt or twist in response to wave action will cause the clamps to bind or "bite into" the piles, rather than slide up or down on the piles. The bearing or backup plate is stationarily secured to the side of the dock, so as to engage one side of the pile. The binding or clamping plate is arranged to partially encircle and engage the surface of the pile remote from the bearing plate and adjustable bolts and springs are connected with the clamping plate so as to hold it in close, sliding contact with the pile.

The primary object of this invention is to provide a mechanically efficient anchoring system for a floating dock which functions to stabilize and hold the dock against undesired pitching and rolling under wave action, but which will permit the dock to rise and fall with gradual changes in water level.

Figure 1:
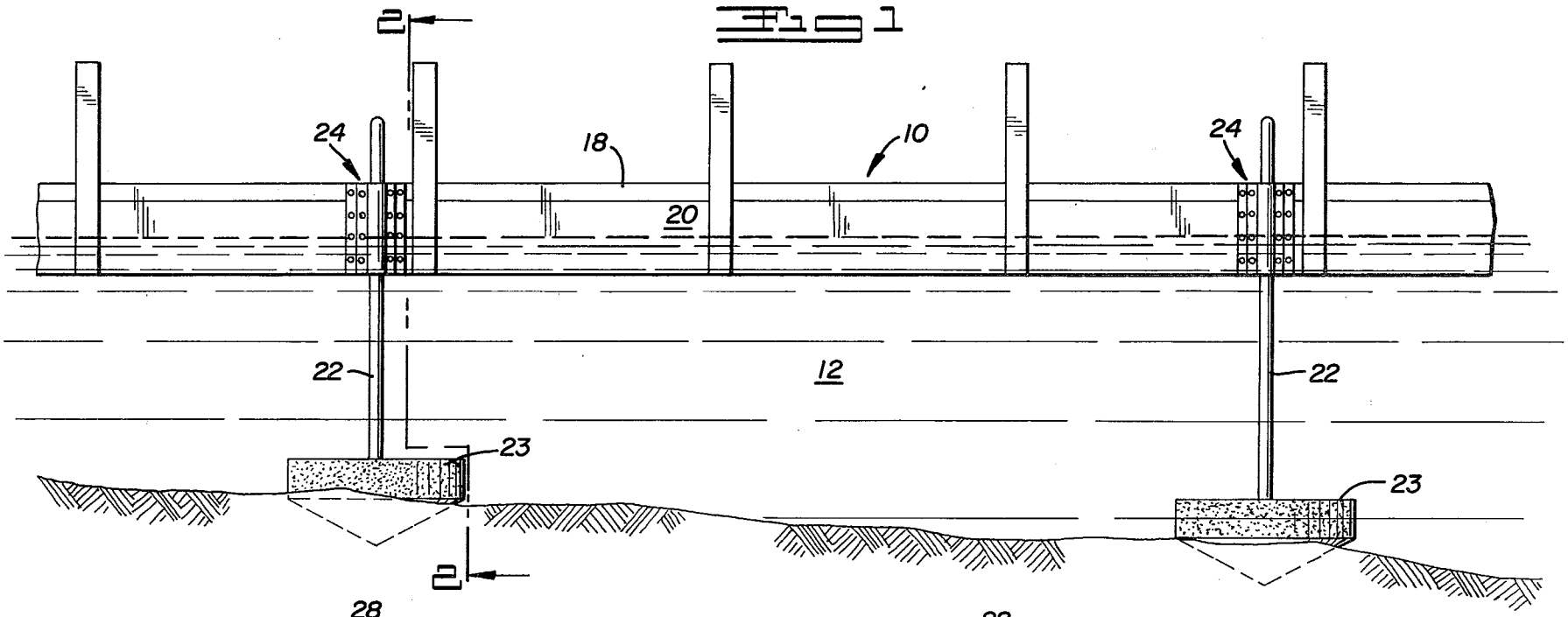
FIG. 1 is a fragmentary elevational view of a dock floating on water and maintained in position by an anchoring system according to this invention.

DESCRIPTION OF THE PREFERRED EMBODIMENT:

FIG. 1 illustrates a buoyant, floating dock 10 floating on a body of water 12 having a bed or bottom 14. The dock includes a framework 16 supporting a deck 18 and sides 20. The dock may also include one or more buoyancy chambers (not shown) filled with trapped air and/or a low density, foamed plastic, and it may, if desired, support a boathouse, or otherwise provide a mooring structure for boats and other watercraft.

The dock 10 is itself moored or anchored to a plurality of generally vertically arranged, bottom-anchored piles 22 which are of a length to extend well above the dock at maximum water level and which are positioned closely adjacent the side walls 20 of the dock.

Figure 2:
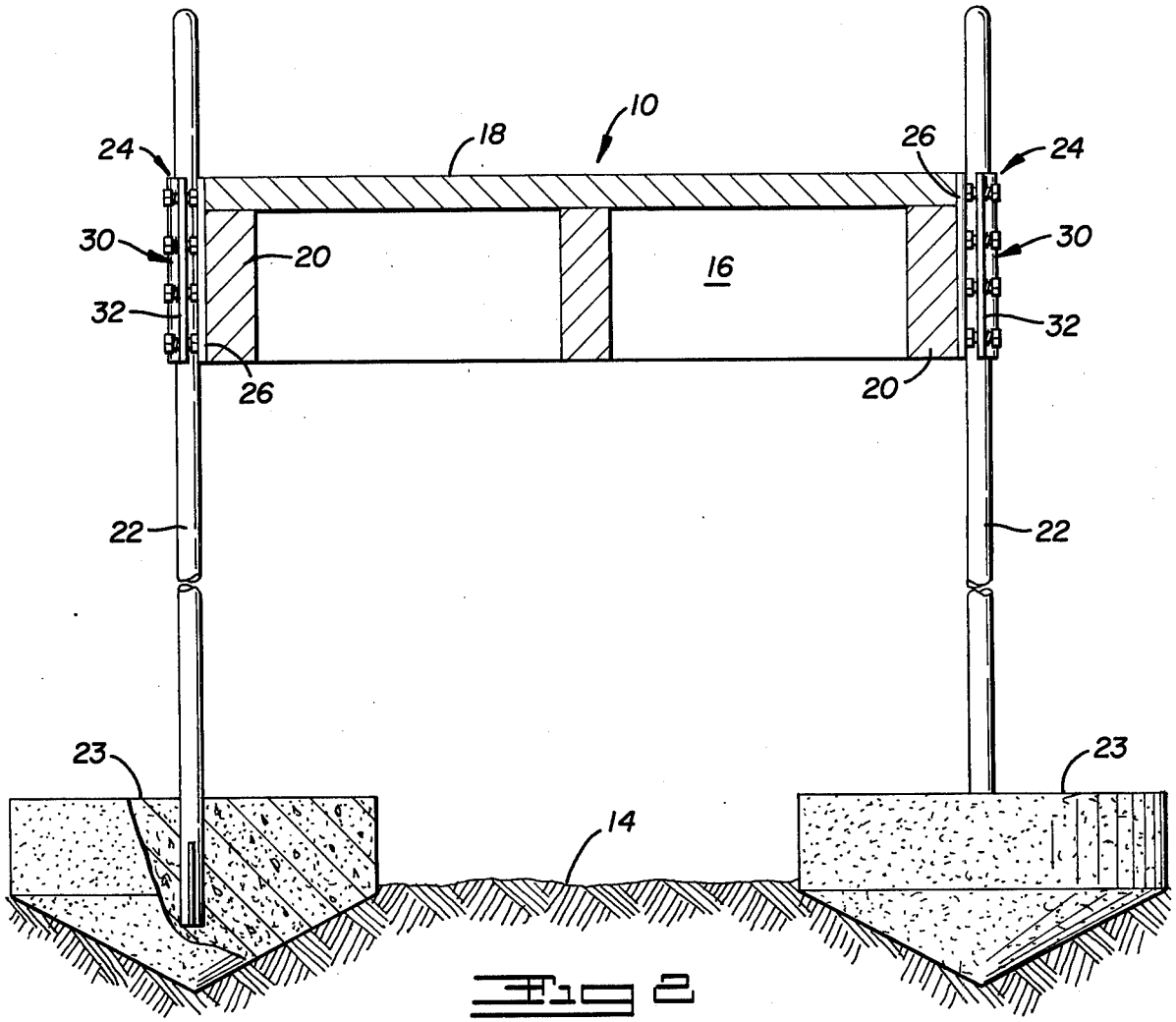
FIG. 2 is a transverse, vertical sectional view of the dock taken along line 2—2 of FIG. 1.
Figure 3:
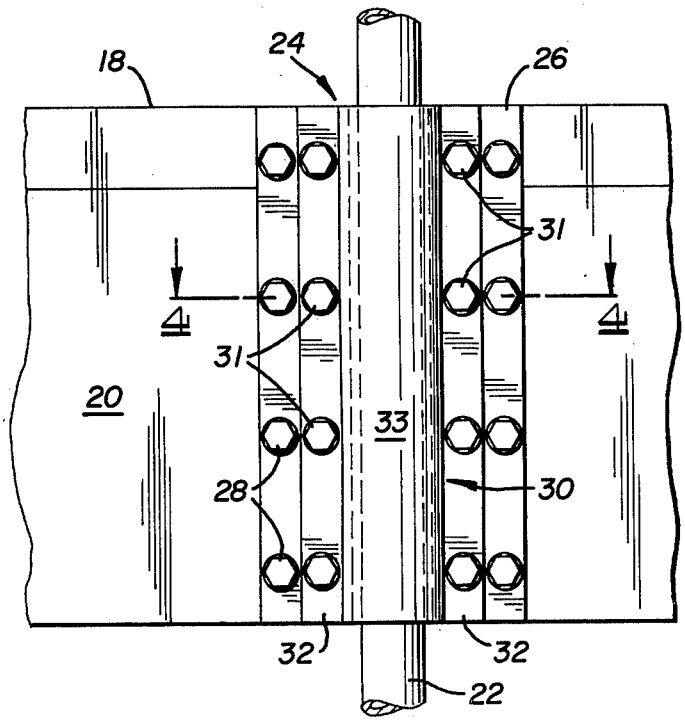
FIG. 3 is an enlarged elevational view of the pile clamping means of this invention.

The particular mechanism for anchoring or securing the piles 22 to the bottom 14 is not a part of this invention. The piles may be anchored by driving them well into the bottom, cementing them to a rock bottom, or moulding a concrete anchor to one end of the pile prior to its installation (as indicated by the pyramid shaped anchors 23 of FIGS. 1 and 2). Also, while the piles 22 have been illustrated in the form of cylindrical tubes or pipes they may also comprise solid or hollow rods of circular or multi-angular cross sections.

Figure 4:
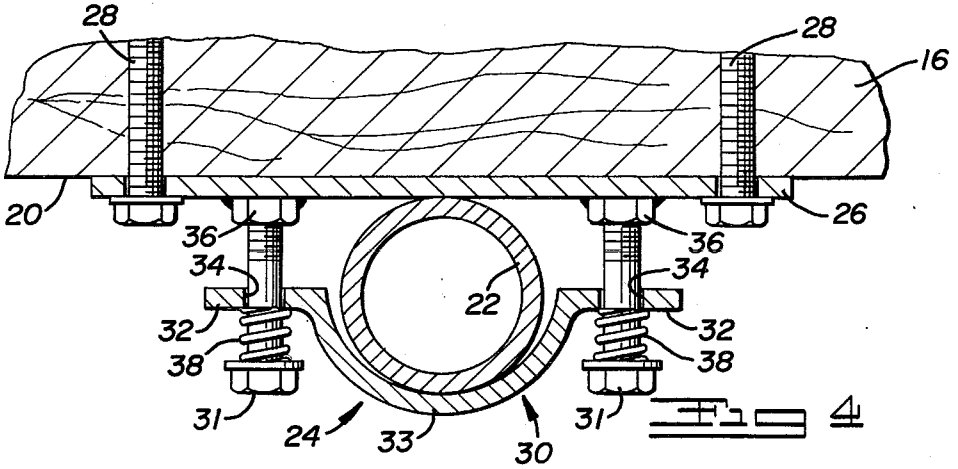
FIG. 4 is a horizontal sectional view of the clamping means taken along line 4—4 of FIG. 3.

Each pile is slidingly attached to a side of the dock by clamping means, indicated generally at 24. Each clamping means comprises a vertically elongated backup or bearing plate 26 secured to a side wall 20 of the dock by lag bolts 28, or equivalent fastening means, and a vertically elongated clamping plate 30 secured to the bearing plate 26 by headed bolts 31. As shown particularly in FIG. 4, the clamping plate 30 has a relatively shallow U-shaped cross sectional configuration which includes an arcuate bight portion 33 and opposite outwardly turned side flanges 32. The radius of curvature of the bight portion 33 of the clamping plate 30 is preferably greater than that of the outer surface of the pile 22 to provide for extended line contact between the clamping plate and the pile. Each side flange 32 of the clamping plate is formed at vertically spaced intervals with apertures or openings 34 through which the shanks of the bolts 31 freely pass. The bolts 31 are threaded into sockets 36 which may take the form of internally threaded nuts welded at correspondingly spaced intervals to the bearing plate 26. A compression spring 38 is positioned between the flange 32 of the clamping plate 30 and the heads of each of the bolts 31, so as to resiliently maintain the clamping plate 30 in line contact with the pile at all times. Clamping pressure of the clamping plate 30 on the pile may be adjusted by tightening or loosening the bolts 31 in their sockets 36.

As will be readily apparent, the clamping assemblies 24 function to slidably confine the piles 22 between the bearing plates 26 and the clamping plates 30 while at the same time preventing any angular tilting of the clamping assemblies relative to the axes of the piles. This permits the dock 10 and the clamping assemblies 24 carried thereby to rise or fall vertically or axially relative to the piles, but any tendency of the dock to tilt or twist under wave action, either longitudinally or transversely will be resisted due to the extended close fitting relation of the clamping assemblies and the piles and the tendency of the edges of the plates 26 and 30 to dig into the piles should they be tilted into angular, non-parallel relation to the axes of the piles.

By providing only line contact between the outer cylindrical surfaces of the piles and the bearing and clamping plates of the clamp assemblies 24, frictional resistance to axial sliding movement of the clamp assemblies on the piles 22 is minimized, and thus, the dock may rise and fall freely with a corresponding gradual change of water level.

In view of the foregoing, it will be appreciated that this invention provides a structually simple, yet mechanically efficient anchoring system for a floating dock and one which functions to stabilize and hold the dock steady against short cycle wave action while permitting the dock to follow the level of the water during gradual seasonal or tidal changes.

While a single preferred embodiment of the invention has been illustrated and described in detail, it will be understood that various modifications in design and details of construction are possible without departing from the spirit of the invention or the scope of the following claims.

I claim:

1. In combination; a bouyant floating dock having a substantially horizontal deck and opposite, vertical side walls; a pair of relatively spaced apart parallel and substantially stationary cylindrical piles extending vertically upwardly and closely adjacent the opposite side walls of said dock; vertically elongated substantially flat bearing plates secured to the respective side walls of said dock and arranged for vertically extended line contact with said piles along one side thereof; vertically elongated clamps having inner arcuate bearing surfaces of greater radius of curvature than the cylindrical surface of said piles and disposed in vertically extended line contact with said piles along the sides thereof opposite said bearing plates; and means connecting said clamps with said bearing plates and for maintaining said clamps and bearing plates in sliding, line contact with said piles, said bearing plates and clamps permitting said dock to rise and fall between said piles with gradual changes in water level while holding said dock against rocking movement in response to wave action.

* * * * *